US008215994B2

(12) United States Patent
Duenas et al.

(10) Patent No.: US 8,215,994 B2
(45) Date of Patent: Jul. 10, 2012

(54) CARD EDGE CONNECTOR HAVING LESS RESONANCE

(75) Inventors: Gustavo F. Duenas, Placentia, CA (US); Ze-Lin Yao, Kunshan (CN); Jason Chou, San Jose, CA (US); Xue-Wu Bu, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/906,176

(22) Filed: Oct. 18, 2010

(65) Prior Publication Data

US 2012/0094542 A1 Apr. 19, 2012

(51) Int. Cl.
*H01R 24/00* (2011.01)

(52) U.S. Cl. ..... 439/637

(58) Field of Classification Search ..... 439/637, 439/63

See application file for complete search history.

(56) References Cited

U.S. PATENT DOCUMENTS 6,652,322 B2 * 11/2003 Ito et al. ..... 439/637
6,832,933 B2 12/2004 Bu et al.
7,128,611 B2 10/2006 Tanaka
7,744,376 B2 * 6/2010 Vrenna et al. ..... 439/60

* cited by examiner

*Primary Examiner* — Phuong Dinh
(74) *Attorney, Agent, or Firm* — Wei Te Chung; Andrew C. Cheng; Ming Chieh Chang

(57) ABSTRACT

A card edge connector for use with a daughter board, and comprises an insulative elongated housing extending along a longitudinal direction, and defining opposite first and second side walls and a central slot formed therebetween for receiving the daughter board therein, a plurality of contacts each defining a retention portion retained in the housing, a resilient contact portion extending into the central slot from an upper portion of the retention portion for contacting with the daughter board, and a solder tail extending out of the housing form a lower portion of the retention portion. Wherein the contacts include a first row of contacts disposed in the first side wall, and a second row of contacts disposed in the second side wall. The first row of contacts have at least two adjacent grounding contacts electrically connected with each other during the contact portions of the contacts are contacting with the daughter board.

17 Claims, 15 Drawing Sheets

CARD EDGE CONNECTOR HAVING LESS RESONANCE

BACKGROUND OF THE INVENTION

1. Field of the Invention

The present invention relates to a card edge connector, more particularly to a card edge connector having less resonance during transferring high-speed signals.

2. Description of Related Art

Card edge connectors are employed widely in computers to receive a memory card for increasing memory capacity of the computers. With rapid development of electronic industry, the computer requires a card edge connector for transferring high-speed signals. Therefore, the card edge connector is arranged with a plurality of grounding contacts, and a plurality of differential contact pairs for transferring differential signals. The grounding contacts and the differential contact pairs are arranged in one row. However, while the memory card is inserted into the card edge connector, the resonances of contacts in the card edge connector is increased at the same time. Thus it affect the high-speed signal transmission stability of card edge connector.

Hence, an improved card edge connector with improved card restriction structure is needed to solve the problem above.

BRIEF SUMMARY OF THE INVENTION

According to one aspect of the present invention, a card edge connector for use with a daughter board, and comprises an insulative elongated housing extending along a longitudinal direction, and defining opposite first and second side walls and a central slot formed therebetween for receiving the daughter board therein; a plurality of contacts each defining a retention portion retained in the housing, a resilient contact portion extending into the central slot from an upper portion of the retention portion for contacting with the daughter board, and a solder tail extending out of the housing form a lower portion of the retention portion; wherein the contacts include a first row of contacts disposed in the first side wall, and a second row of contacts disposed in the second side wall, the first row of contacts have at least two adjacent grounding contacts electrically connected with each other during the contact portions of the contacts contacting with the daughter board.

According to another aspect of the present invention, a card edge connector for use with a daughter board, and comprises an insulative elongated housing extending along a longitudinal direction, and defining opposite first and second side walls and a central slot formed therebetween for receiving the daughter board therein; a plurality of contacts each defining a resilient contact portion extending into the central slot for mating with the daughter board; wherein the contacts include a first row of contacts disposed in the first side wall, the first row of contacts have a plurality of grounding contact pairs each of which are electrically connected with each other during the contacts are mating with the daughter board, and a plurality of differential contact pairs, the grounding contact pairs are staggered with the differential contact pairs along the longitudinal direction.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

Figure 1:
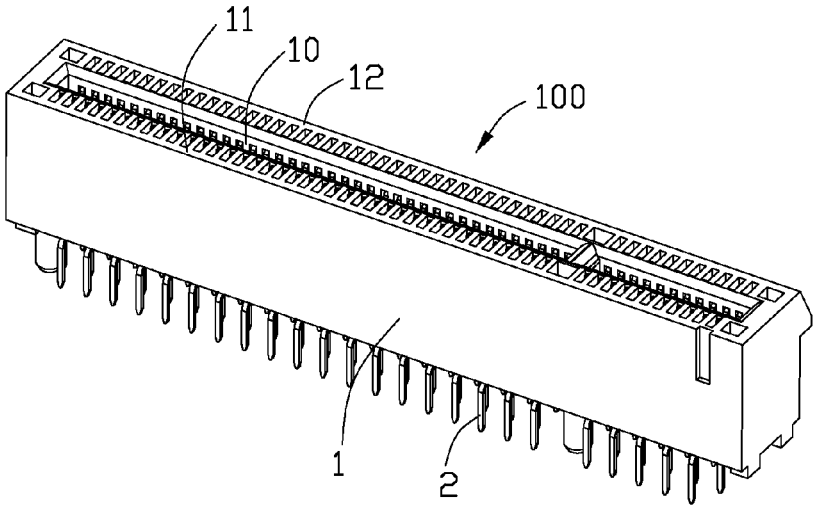
FIG. 1 is a perspective view of a card edge connector in accordance with a first embodiment of the present invention.
Figure 2:
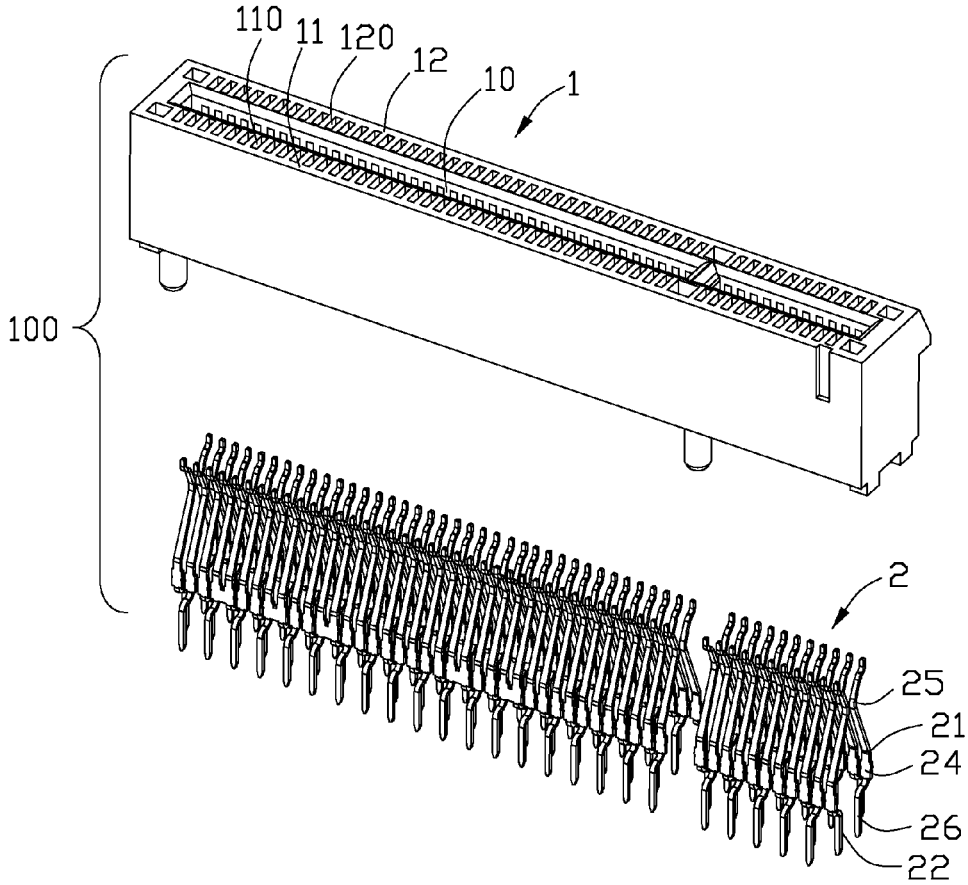
FIG. 2 is an exploded view of the card edge connector shown in the FIG. 1.
Figure 3:
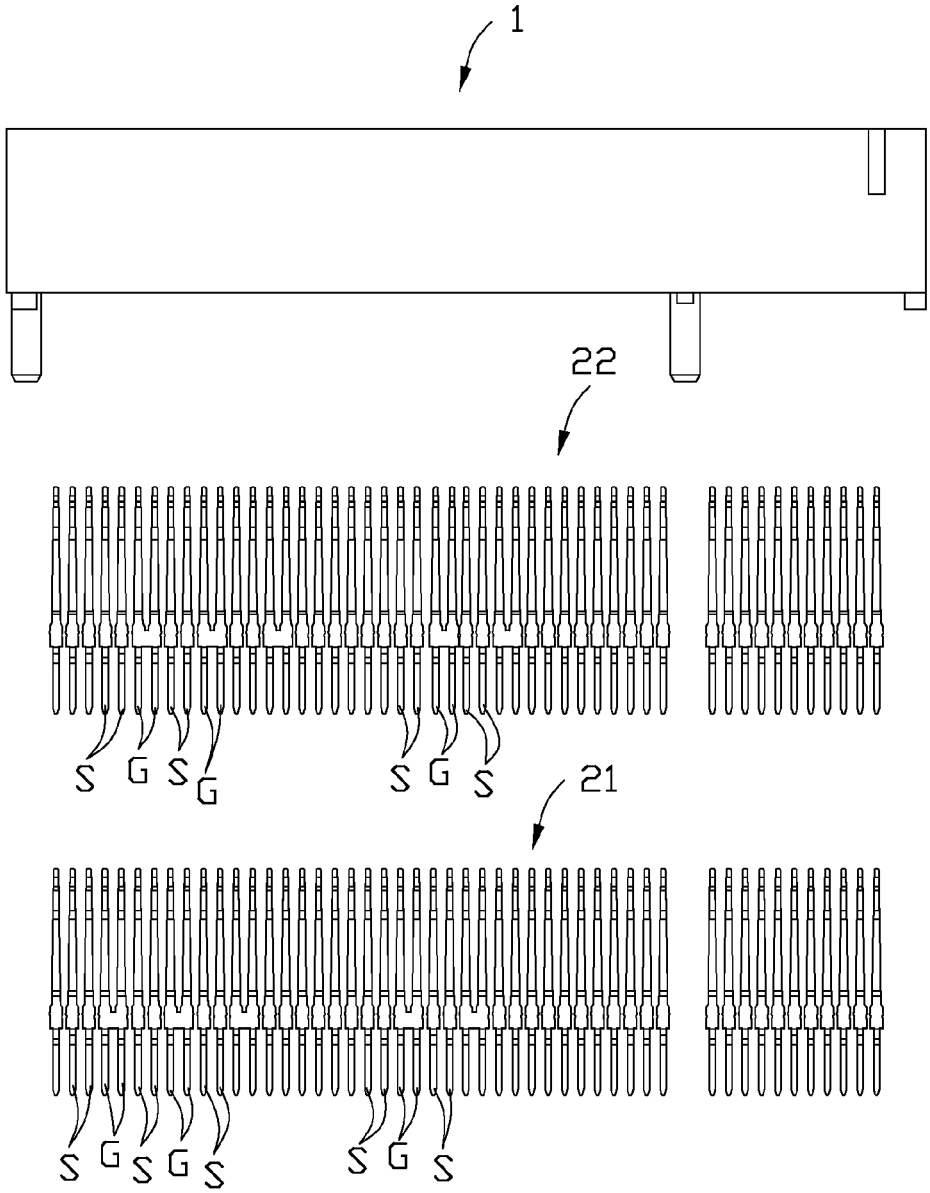
FIG. 3 is another exploded view of the card edge connector shown in the FIG. 1.
Figure 4:
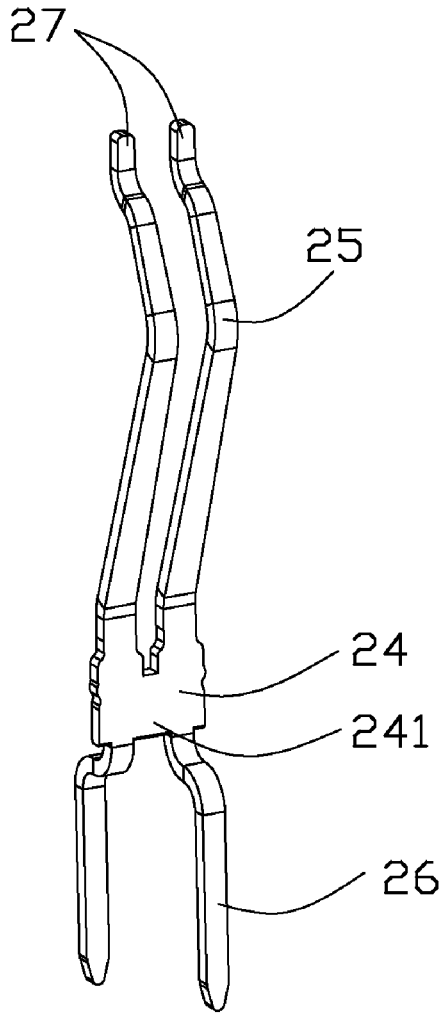
FIG. 4 is a perspective view of two grounding contacts of the card edge connector shown in the FIG. 1, which are connected to each.
Figure 5:
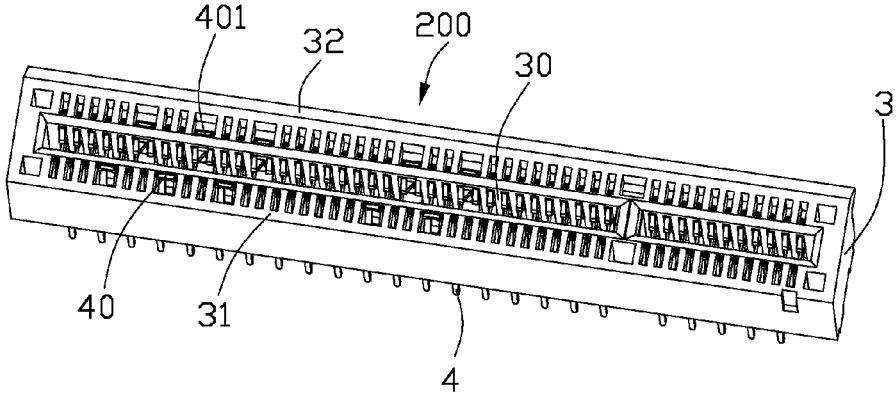
FIG. 5 is a perspective view of a card edge connector in accordance with a second embodiment of the present invention.
Figure 6:
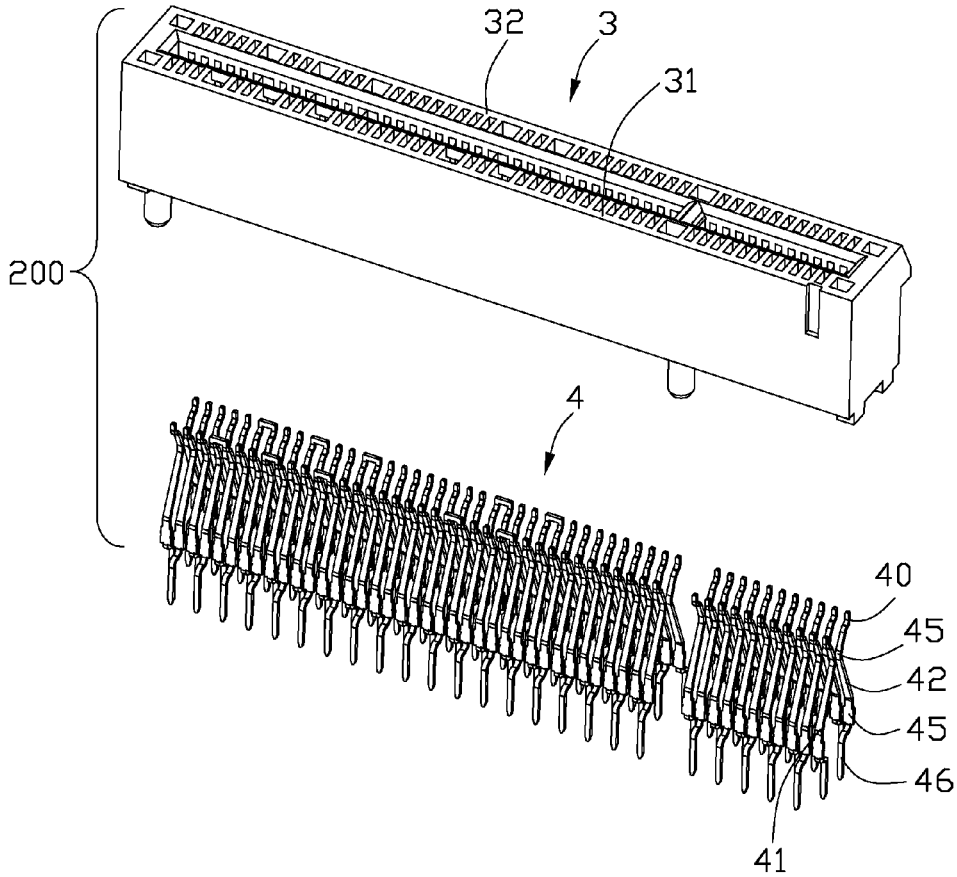
FIG. 6 is an exploded view of the card edge connector shown in the FIG. 5.
Figure 7:
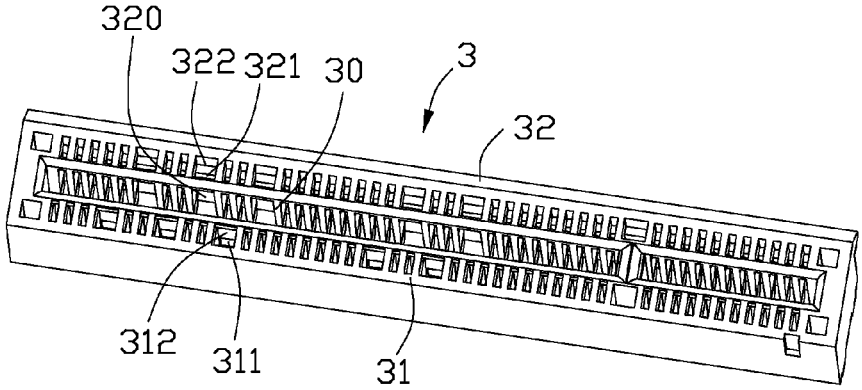
FIG. 7 is a perspective view of an elongated housing of the card edge connector shown in the FIG. 5.
Figure 8:
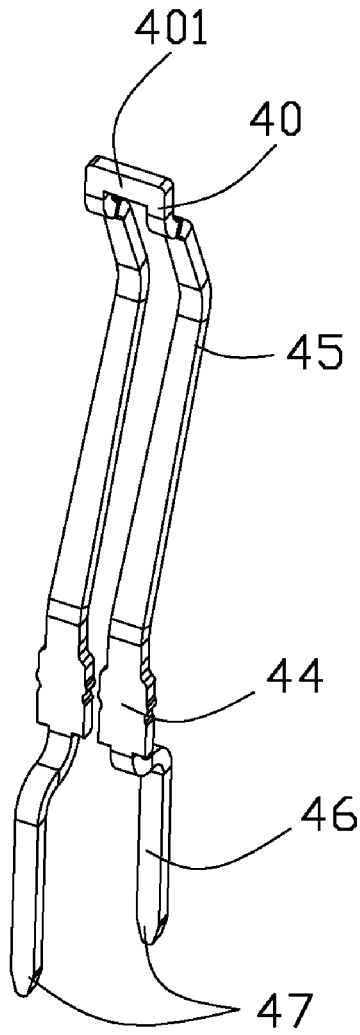
FIG. 8 is a perspective view of two grounding contacts of the card edge connector shown in the FIG. 5, which are connected to each.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

With reference to FIGS. 1-4, a card edge connector 100 in accordance with a first embodiment of the present invention, which is adapted for mounting on a mother board (not shown) and receiving a daughter board (not shown). The card edge connector 100 is a x8 PCI (Pedpherd Component Interconnect) Express connector and comprises an elongated housing 1, a plurality of conductive contacts 2 retained in the insulative housing 1.

The housing 1 defines a central slot 10 extending along a longitudinal direction thereof and located between first and second side walls 11, 12. The first side wall 11 defines a first row of passageways 110 in communication with the central slot 10. The second side wall 12 also defines a second row of passageways 120 parallel to the first row of passageways 110 and in communication with the central slot 10.

The contacts 2 include a first row of contacts 21 disposed in the first side wall 11, and a second row of contacts 22 disposed in the second side wall 12. Each of the first contact 21 and the second contact 22 includes a retention portion 24 retained in the passageway 110, 120 of the side walls 11, 12, a resilient contact portion 25 protruding into the central slot 10 for mating with the daughter board from an upper portion of the retention portion 24, and a vertical solder tail 26 extending downwardly out of the housing 1 from a lower portion of the retention portion 24. The solder tails 26 of the contacts 2 are for being mounted on the mother board. Each row of the first contacts 21 and the second contacts 22 have same pitch between each two adjacent solder tails 26.

Each row of the first contacts 21 and the second contacts 22 include at least three pairs of grounding contacts (G, G) 27, and five pairs of differential contacts (S, S) 28 for transferring differential signals. Each pair of grounding contacts 27 are located between adjacent two pairs of the differential contacts 28. Each pair of grounding contacts 27 are integrally connected with each other. It could eliminate resonance between each adjacent two pairs of differential contacts 28 after the daughter board is inserted into the card edge connector 100. The grounding contacts 27 of the first row of contacts 21 and the grounding contacts 27 of the second row of contacts 22 are alternately staggered with each other along a transverse direction perpendicular to the longitudinal direction. The retention portions 24 of each pair of grounding contacts 27 define a connect portion 241 integrally connected therebetween. Each adjacent two passageways 110, 120 which are adapted for retaining the grounding contacts 27 are communicated with each other along the longitudinal direction to form a retaining slot (not shown) therebetween for retaining the connect portion 241 therein. It is noted that in this embodiment even though more grounding contacts 27 between the two pairs of the differential pairs may perform better electrical character, it is improper to link more than two grounding contacts together in the longitudinal direction because the staggered solder tails 26 may lose their true positions mechanically. Therefore, only one pair of grounding contacts 27 is preferred to meet both the electrical and mechanical conditions.

With reference to FIGS. 5-8, a card edge connector 200 in accordance with a second embodiment of the present invention. The card edge connector 200 comprises an elongated housing 3, a plurality of conductive contacts 4 retained in the insulative housing 3.

The housing 3 defines a central slot 30 extending along a longitudinal direction thereof and located between first and second side walls 31, 32. The first side wall 31 defines a first row of passageways 310 in communication with the central slot 30, a first row of receiving spaces 311 recessed from an upper portion thereof. The receiving spaces 311 are in communication with the central slot 30 and the passageways 310 respectively. The second side wall 32 defines a second row of passageways 320, and a second row of receiving spaces 321 recessed from an upper portion thereof. The receiving spaces 311, 321 are in communication with the central slot 30 and the passageways 310, 320 respectively.

The contacts 4 include a first row of contacts 41 disposed in the first side wall 31, and a second row of contacts 42 disposed in the second side wall 32. Each of the first contact 41 and the second contact 42 includes a retention portion 44 retained in the passageway 310, 320, a resilient contact portion 45 protruding into the central slot 30 for mating with the daughter board from an upper portion of the retention portion 44, a vertical solder tail 46 extending downwardly out of the housing 1 from a lower portion of the retention portion 24, and an end portion 40 extending from an upper portion of the contact portion 45. The retention portions 44 of the contacts 4 are retained in the passageways 310, 320 respectively. The end portions 40 of the contacts 4 are movable in the receiving spaces 311, 321 along a transverse direction perpendicular to the longitudinal direction respectively.

Each row of the first contacts 41 and the second contacts 42 include at least three pairs of grounding contacts 47 and five pairs of differential contacts 48 for transferring differential signals. Each pair of grounding contacts 47 are located between adjacent two pairs of differential contacts 47. Each adjacent two pairs of differential contacts 48 have a pair of grounding contacts 48 integrally connected with each other. It could eliminate resonance between each adjacent two pairs of differential contacts 48 after the daughter board is inserted into the card edge connector 200. The grounding contacts 47 of the first row of contacts 41 and the grounding contacts 47 of the second row of contacts 42 are alternately staggered with each other along a transverse direction perpendicular to the longitudinal direction. The end portions 40 of each pair of grounding contacts 48 are integrally connected with each other to form a connect portion 401 therebetween. The end portions 40 of the grounding contacts 48 are received in adjacent two receiving spaces 311, 321 communicated with each other. Each two adjacent receiving spaces 311, 321 which are adapted for receiving the end portions 40 of the grounding contacts 47 are in communication with each other along the longitudinal direction to form a retaining slot 312, 322 therebetween. The connect portions 401 are received in the retaining slots 312, 322 respectively. The end portions 40 with the connect portion 401 move away from the central slot 30 along the transverse direction respectively while the daughter board is being inserted into the central slot 30.

Figure 9:
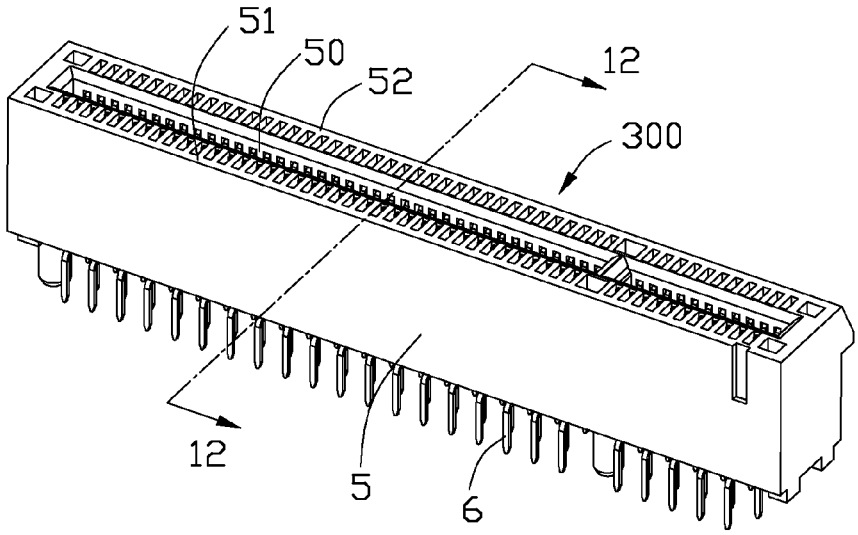
FIG. 9 is a perspective view of a card edge connector in accordance with a third embodiment of the present invention.
Figure 10:
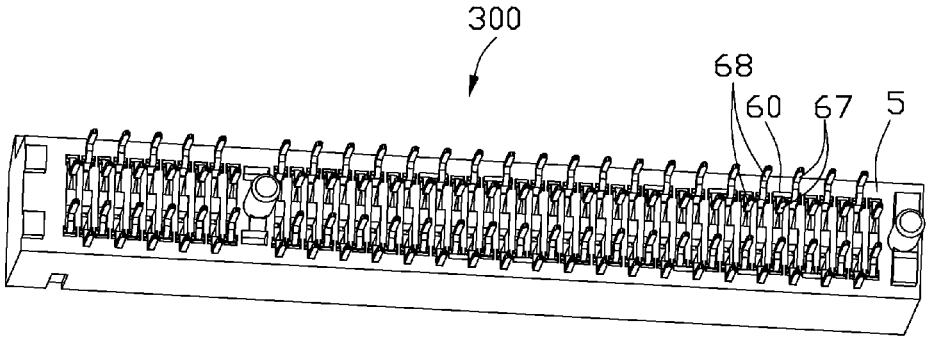
FIG. 10 is another perspective view of a card edge connector in accordance with a third embodiment of the present invention.
Figure 11:
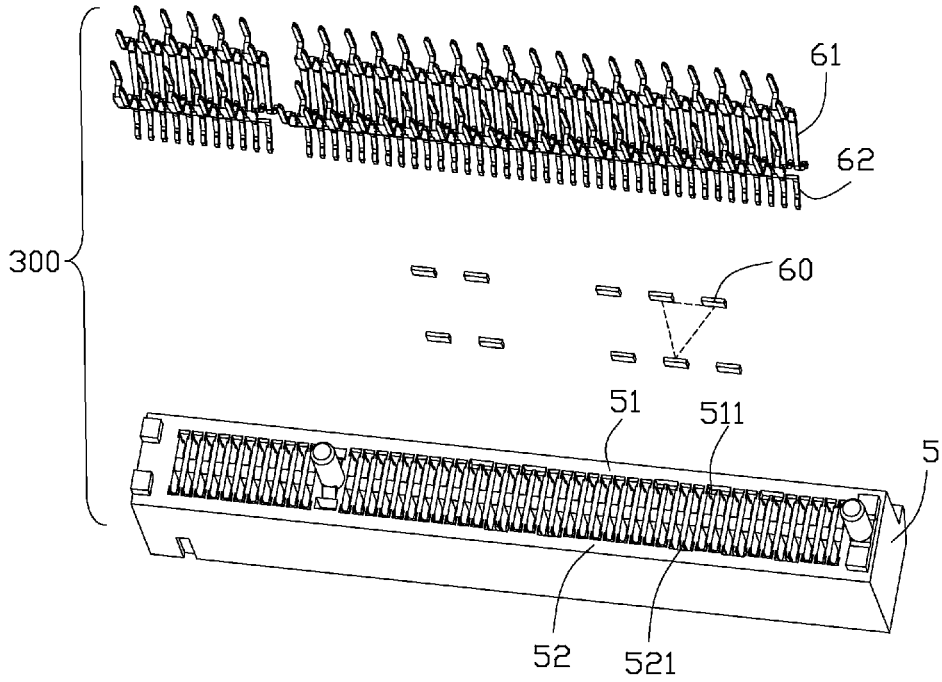
FIG. 11 is an exploded view of the card edge connector shown in the FIG. 9.

With reference to FIGS. 9-11, a card edge connector 300 in accordance with a second embodiment of the present invention. The card edge connector 300 comprises an elongated housing 5, a plurality of conductive contacts 6 retained in the insulative housing 5.

The housing 5 defines a central slot 50 extending along a longitudinal direction thereof and located between first and second side walls 51, 52. The first side wall 51 defines a first row of passageways 510 in communication with the central slot 50, a first row of retaining slots 511 recessed upwardly from a bottom portion thereof. The retaining slots 511 are in communication with the central slot 50 and the passageways 510 respectively. The second side wall 52 defines a second row of passageways 520, and a second row of retaining slots 521 recessed upwardly from a bottom portion thereof. The retaining slots 511, 521 are disposed at outer sides of the passageways 510, 520 and in communication with the passageways 510, 520 respectively.

The contacts 6 include a first row of contacts 61 disposed in the first side wall 61, and a second row of contacts 62 disposed in the second side wall 62. Each of the first row of contacts 61 and the second row of contacts 62 include a retention portion 64 retained in the passageway 610, 620, a resilient contact portion 65 protruding into the central slot 50 for mating with the daughter board from an upper portion of the retention portion 64, and a vertical solder tail 66 extending downwardly out of the housing 5 from a lower portion of the retention portion 64. The retention portions 64 of the contacts 6 are retained in the passageways 510, 520 respectively.

Each row of the first contacts 61 and the second contacts 62 include at least three pairs of grounding contacts 67, and five pairs of differential contacts 68 for transferring differential signals. Each pair of grounding contacts 67 are located between adjacent two pairs of differential contacts 68. The card edge connector 100 further comprises six metallic connect plates 60 retained upwardly in the retaining slots 511, 521 and corresponding to the grounding contacts 67. The retaining slots 511, 521 which correspond to each pair of grounding contacts 67 are in communication with each other. The retention portions 64 of each pair of grounding contacts 67 contact with the connect plate 60 respectively. Thus, each pair of the grounding contacts 67 are electrically connected with each other for eliminating resonance between each adjacent two pairs of differential contacts 68 after the daughter board is inserted into the card edge connector 300. The grounding contacts 67 of the first row of contacts 61 and the grounding contacts 67 of the second row of contacts 62 are alternately staggered with each other along a transverse direction perpendicular to the longitudinal direction. One of connect plates 60 which are disposed in one of the first side wall 51 and the second side wall 52 and adjacent two connect plates 60 which are disposed in the other one of the first side wall 51 and the second side wall 52 are arranged in three vertexs of an isosceles triangle.

Figure 12:
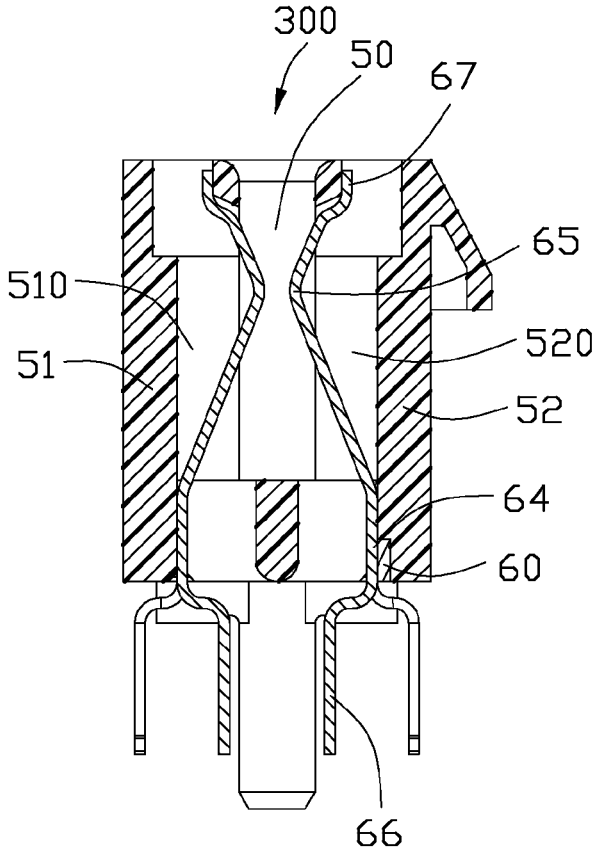
FIG. 12 is a cross-sectional view of the card edge connector along line 12-12 of FIG. 9.
Figure 13:
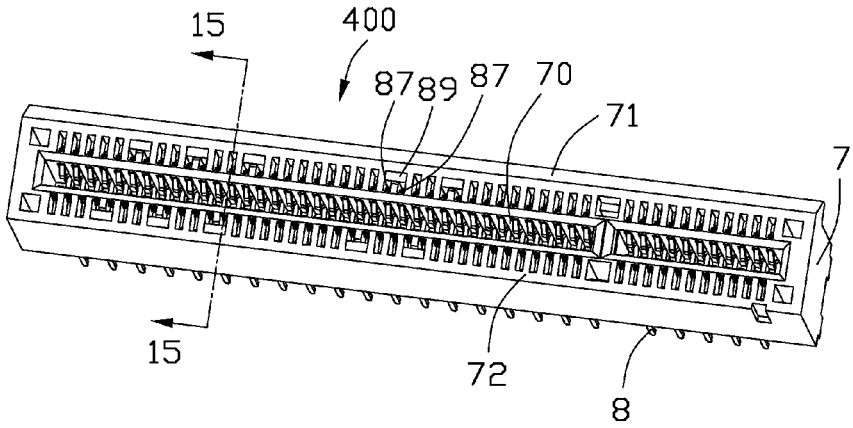
FIG. 13 is a perspective view of a card edge connector in accordance with a forth embodiment of the present invention.
Figure 14:
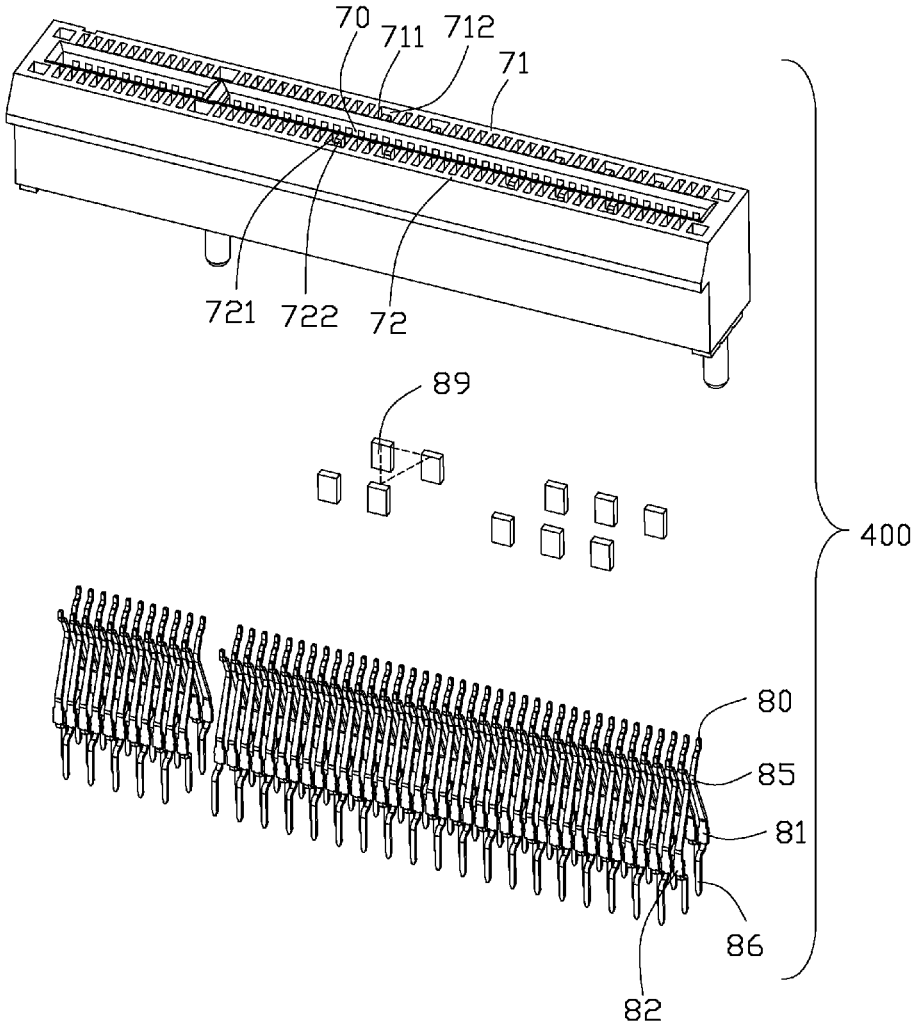
FIG. 14 is an exploded view of the card edge connector shown in the FIG. 13.
Figure 15:
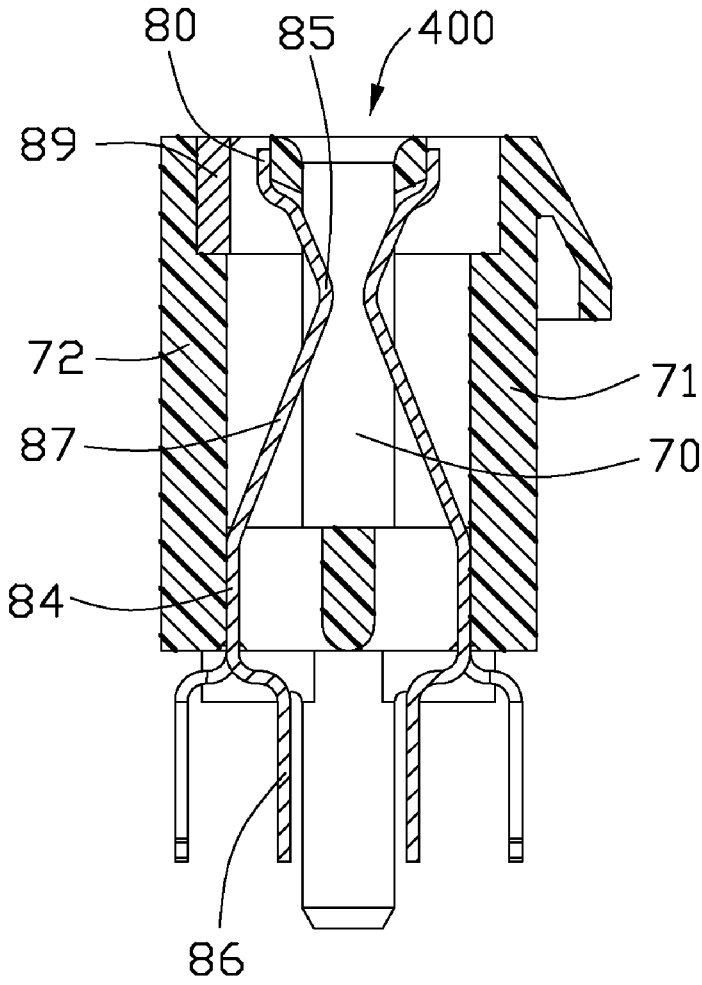
FIG. 15 is a cross-sectional view of the card edge connector along line 15-15 of FIG. 13.

With reference to FIGS. 12-14, a card edge connector 400 in accordance with a forth embodiment of the present invention. The card edge connector 400 comprises an elongated housing 7, a plurality of conductive contacts 8 retained in the insulative housing 7.

The housing 7 defines a central slot 70 extending along a longitudinal direction thereof and located between first and second side walls 71, 72. The first side wall 71 defines a first row of passageways 710 in communication with the central slot 70, a first row of receiving space 711 recessed downwardly from an upper portion thereof, and a first row of retaining slots 712 recessed downwardly from the upper portion thereof and in communication with the passageway 710. The second side wall 72 defines a second row of passageways 320, a second row of receiving space 721 recessed downwardly from an upper portion thereof, and a second row of retaining slots 722 recessed downwardly form the upper portion thereof and in communication with the receiving space 721. The receiving spaces 711, 721 are in communication with the central slot 30 and the passageways 710, 720 respectively. The retaining slots 712, 722 are disposed at outer sides of the receiving spaces 711, 721 respectively.

The contacts 8 include a first row of contacts 81 disposed in the first side wall 71, and a second row of contacts 82 disposed in the second side wall 72. Each the first row of contacts 81 and the second row of contacts 82 include a retention portion 84 retained in the passageway 710, 720, a resilient contact portion 85 protruding into the central slot 70 for mating with the daughter board from an upper portion of the retention portion 84, a vertical solder tail 86 extending downwardly out of the housing 7 from a lower portion of the retention portion 84, and an end portion 80 extending from an upper portion of the contact portion 85. The retention portions 84 of the contacts 8 are retained in the passageways 710, 720 respectively. The end portions 80 of the contacts 8 are movable in the retaining slots 711, 721 along a transverse direction perpendicular to the longitudinal direction respectively.

Each of the first row of contacts 81 and the second row of contacts 82 include at least three pairs of grounding contacts 87, and five pairs of differential contacts 87 for transferring differential signals. Each pair of grounding contacts 87 are located between adjacent two pairs of differential contacts 88. The card edge connector 100 further comprises six metallic connect plates 89 retained upwardly in the retaining slots 712, 722 and corresponding to the grounding contacts 87. One of connect plates 89 which are disposed in one of the first side wall 71 and the second side wall 72 and adjacent two connect plates 89 which are disposed in the other one of the first side wall 71 and the second side wall 72 are arranged in three vertexs of an isosceles triangle. The retaining slots 712, 722 which correspond to each pair of grounding contacts 87 are in communication with each other. The end portions 80 of the grounding contacts 87 are spaced inwardly from the connect plates 89 along the transverse direction.

While the daughter board is being inserted in the central slot 70, the daughter board abuts against the contact portions 85 of each pair of the grounding contacts 87 with the end portions 80 moving to contact the connect plate 89. Thus, each pair of the grounding contacts 87 are electrically connected with each other after the daughter board is inserted in the card edge connector 100. It could eliminate resonance between each adjacent two pairs of differential contacts 68 after the daughter board being inserted into the card edge connector 400. The grounding contacts 87 of the first row of contacts 61 and the grounding contacts 87 of the second row of contacts 82 are alternately staggered with each other along a transverse direction perpendicular to the longitudinal direction.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

We claim:

1. A card edge connector for use with a daughter board, comprising:

an insulative elongated housing extending along a longitudinal direction thereof, the housing defining opposite first and second side walls and a central slot formed therebetween for receiving the daughter board therein; and a plurality of contacts each defining a retention portion retained in the housing, a resilient contact portion extending into the central slot from an upper portion of the retention portion for contacting with the daughter board, and a solder tail extending out of the housing from a lower portion of the retention portion;

wherein the contacts include a first row of contacts disposed in the first side wall, and a second row of contacts disposed in the second side wall, the first row of contacts have at least two pairs of differential contacts, and at least two adjacent grounding contacts electrically connected with each other during the contact portions of the contacts contacting with the daughter board and located between adjacent the two pairs of differential contact in the longitudinal direction.

2. The card edge connector as claimed in claim 1, wherein at least one of the retention portions, the contact portions and the solder tails of the two grounding contacts are integrally connected with each other for the two grounding contacts electrically connected with each other.

3. The card edge connector as claimed in claim 1, wherein the first side wall defines a first row of passageway correspond to the first row of contacts, and two adjacent receiving spaces recessed downwardly from an upper portion thereof, the receiving space are in communication with each other along the longitudinal direction to form a retaining slot therebetween, the receiving spaces are in communication with the central slot respectively, the grounding contacts each defines an end portion extending upwardly into the receiving space from the contact portion, the end portions of the grounding contacts are integrally connected to each other to form a connect portion therebetween, the connect portion is received in the retaining slot.

4. The card edge connector as claimed in claim 1, wherein the card edge connector includes a metallic connect plate retained in the first side wall and separated from the contacts, both of the grounding contacts contact with the connect plate during the contact portions of the contacts are contacting with the daughter board.

5. The card edge connector as claimed in claim 4, wherein the first side wall defines a first row of passageways correspond to the first row of contacts, two adjacent receiving spaces recessed downwardly from an upper portion thereof, and a retaining slot recessed downwardly from the upper portion thereof, the receiving spaces are in communication with the central slot, the retaining slot is in communication with both of the receiving spaces along a transverse direction perpendicular to the longitudinal direction, the connect plate is retained in the retaining slot, the grounding contacts each defines an end portion extending upwardly aparted from the contact portion, the end portions are movable in the receiving space and spaced from the connect plate, the end portions of the grounding contact with the connect plate for ensuring the grounding contacts to be electrically connected with each other during the contact portions of the contacts are contacting with the daughter board.

6. The card edge connector as claimed in claim 4, wherein the first side wall defines a first row of passageway correspond to the first row of contacts, and two adjacent retaining slots recessed upwardly from a lower portion thereof, the retaining slots are in communication with each other along the longitudinal direction, the retaining slots are in communication with the passageways along the transverse direction respectively, the retention portions of the grounding contacts are retained in the passageways respectively, the connect plate is retained upwardly in the retaining slots, the connect plate contacts with the retention portions of the grounding contacts for ensuring the grounding contacts to be electrically connected with each other.

7. The card edge connector as claimed in claim 1, wherein each row of the first contacts and the second contacts include at least three pairs of grounding contacts, and five pairs of differential contacts, each pair of grounding contacts have two pairs of differential contacts located at two opposite sides thereof, each adjacent two pairs of differential contacts have a pair of grounding contacts integrally connected with each other during the contact portions of the contacts are contacting with the daughter board.

8. The card edge connector as claimed in claim 7, wherein the card edge connector includes at least six metallic connect plates disposed in the side walls respectively, each of the connect plates is adapted to electrically connect between each pair of grounding contacts, one of the connect plates which are disposed in one of the first side wall and the second side wall and adjacent two connect plates which are disposed in the other one of the first side wall and the second side wall are arranged in three vertexs of an isosceles triangle.

9. The card edge connector as claimed in claim 7, wherein the grounding contacts of the first row of contacts and the grounding contacts of the second row of contacts are alternately staggered with each other along the transverse direction, each row of the first contacts and the second contacts have same pitch between each two adjacent solder tails in the longitudinal direction.

10. A card edge connector for use with a daughter board, and comprising:

an insulative elongated housing extending along a longitudinal direction thereof, and defining opposite first and second side walls and a central slot formed therebetween for receiving the daughter board therein;

a plurality of contacts each defining a resilient contact portion extending into the central slot for mating with the daughter board; and a metallic connect plate retained in the housing;

wherein the contacts include a first row of contacts disposed in the first side wall, the first row of contacts have a plurality of grounding contact pairs, and a plurality of differential contact pairs staggered with the grounding contact pairs along the longitudinal direction, two grounding contacts in one of the grounding contact pairs electrically connect with each other via the connect plate, which is discrete from the grounding contact pairs.

11. The card edge connector as claimed in claim 10, wherein the card edge connector includes a plurality of metallic connect plates disposed in the side wall respectively, the contacts further have a second row of contacts with a plurality of grounding contact pairs and differential contact pairs all of which are retained in the second side wall, each pair of the grounding contact pairs are electrically connected with each other by the connect plate, the connect plates are retained in the first side wall respectively, one of the connect plates which is disposed in one of the first side wall and the second side wall and adjacent two connect plates which are disposed in the other one of the first side wall and the second side wall are arranged in three vertexs of an isosceles triangle.

12. The card edge connector as claimed in claim 11, wherein the first side wall defines a plurality of receiving spaces, and a plurality of retaining slots recessed from an upper portion thereof and in communication with the receiving spaces respectively, each grounding contacts includes an end portion extending upwardly from a upper portion of the contact portion, the end portions of the grounding contacts are movable in the receiving spaces respectively, the connect plates are retained in the retaining slots respectively, the end portions of each of the grounding contact pairs move to contact with the connect plates during the daughter board abutting against the contact portions.

13. The card edge connector as claimed in claim 11, wherein the first side wall defines a row of passageways in communication with the central slot, each of the contacts defines a retention portion extending downwardly from the contact portion, and a solder tail extending out of the housing from the retention portion, the retention portions are retained in the passageways respectively, each of the connect plates is retained in adjacent two passageways corresponding grounding contact pair, two retention portions of the grounding contact pair touch with the connect plate for the grounding contact pair electrically connecting with each other.

14. A card edge connector comprising:

an insulative housing defining a longitudinal slot along a lengthwise direction;

at least one row of passageways disposed by at least one side of the longitudinal slot with equal intervals between every adjacent two passageways;

at least one row of contacts respectively disposed in the corresponding row of passageways, each of said contacts defining a retention section with barb means for retaining the contact to the housing, a contacting section resilient extending from the retention section into the longitudinal slot, and a tail section extending from the retention section out of the housing, said retention sections of said contacts being coplanar with one another in one row, said contacting sections commonly extending in one transverse direction, which is perpendicular to said lengthwise direction, into said longitudinal slot, while said tail sections of the contacts being alternately staggered with one another in two rows located by two sides of said one row of the retention sections, said contacts including a plurality of differential pairs, every adjacent two differential pairs commonly sandwich only one pair of grounding contacts therebetween in said lengthwise direction; wherein said pair of grounding contacts are linked to each other in said lengthwise direction via either the corresponding retention sections or free tips of said contacting sections under condition that said pair of grounding contacts are originally linked to a same contact carrier.

15. The card edge connector as claimed in claim 14, further comprising a plurality of metallic connect plates discrete from the contacts and each touching with either the retention sections or the free tips of the contacting sections of the pair of grounding contacts in condition that the pair of grounding contacts electrically connect with each other via a connect plate.

16. The card edge connector as claimed in claim 15, wherein the connect plates are aligned with each other in the lengthwise direction.

17. The card edge connector as claimed in claim 14, further comprising another row of passageways with corresponding differential pairs and pairs of grounding contacts alternately arranged with each other under condition that the differential pair in the row of the passageways is aligned with the corresponding pair of grounding contacts in said another row of passageways in the transverse direction.

* * * * *